US011497283B2

(12) United States Patent
Kosinski et al.

(10) Patent No.: US 11,497,283 B2
(45) Date of Patent: Nov. 15, 2022

(54) GARMENT LOCKING SYSTEM

(71) Applicants: Kelsey Kosinski, Wilmington, DE (US); Jaeah Augustine Yoo, Newark, DE (US)

(72) Inventors: Kelsey Kosinski, Wilmington, DE (US); Jaeah Augustine Yoo, Newark, DE (US)

( * ) Notice: Subject to any disclaimer, the term of this patent is extended or adjusted under 35 U.S.C. 154(b) by 64 days.

(21) Appl. No.: 16/936,727

(22) Filed: Jul. 23, 2020

(65) Prior Publication Data

US 2022/0022608 A1 Jan. 27, 2022

(51) Int. Cl.

| | |
|---|---|
| ***A44B 99/00*** | (2010.01) |
| ***A44B 1/08*** | (2006.01) |
| *A45C 13/10* | (2006.01) |

(52) U.S. Cl.

CPC ..... *A44B 99/00* (2013.01); *A44B 1/08* (2013.01); *A44D 2203/00* (2013.01); *A45C 13/1069* (2013.01)

(58) Field of Classification Search

CPC .. A44B 1/08; A44B 1/00; A44B 99/00; A45C 13/1069; A41F 1/002

See application file for complete search history.

(56) References Cited

U.S. PATENT DOCUMENTS 3,657,908 A 4/1972 Schwartz et al.
5,572,887 A 11/1996 Geswelli
6,163,938 A * 12/2000 Weber-Unger ..... A41F 1/002 24/303
6,292,985 B1 9/2001 Grunberger
7,640,636 B2 * 1/2010 Clark ..... A44C 17/0216 24/303
8,857,647 B2 * 10/2014 Nakamura ..... B65D 41/04 220/290
9,717,293 B2 * 8/2017 Lim ..... A41F 1/002

OTHER PUBLICATIONS

Fidlock products, available at https://www2.fidlock.com/en (2020).

* cited by examiner

*Primary Examiner* — Robert Sandy
*Assistant Examiner* — Louis A Mercado
(74) *Attorney, Agent, or Firm* — McCarter & English, LLP

(57) ABSTRACT

Exemplary embodiments are directed to a garment locking device appliance. The garment locking device includes a first component including an extension and a base element at one end of the extension. The first component is configured to be secured to a first garment material. The garment locking device includes a second component including a body with a channel formed therein. The channel is dimensioned to accommodate passage of the base element therethrough. The second component is configured to be secured to a second garment material. Passage of the base element of the first component into the channel of the second component detachably couples the first component to the second component, and detachably couples the first garment material to the second garment material. The first and second components include complementary magnetic or ferromagnetic components to assist in detachably coupling the first and second components to each other.

20 Claims, 8 Drawing Sheets

GARMENT LOCKING SYSTEM

TECHNICAL FIELD

The present disclosure relates to a garment locking system and, in particular, to a locking system including magnetic and ferromagnetic components attachable to opposing sides of a garment for detachable fixation relative to each other.

BACKGROUND

Conventional locking systems for garments generally include buttons passable through respective slits in the garment, or zippers. Such conventional locking systems may be difficult to operate by those with disabilities or other medical conditions, such as Parkinson's Disease.

Thus, a need exists for a garment locking system that simplifies engagement of the respective components for those with disabilities. These and other needs are addressed by the garment locking system of the present disclosure.

SUMMARY

In accordance with embodiments of the present disclosure, an exemplary garment locking system is provided. The garment locking system includes first and second components having structure and/or complementary magnetic/ferromagnetic components to assist in detachably coupling the first and second components relative to each other. The first component includes a base element configured to be at least partially passed through a channel of the second component. Engagement of the base element within the channel can detachably couple the first component to the second component. The complementary magnetic/ferromagnetic components associated with each of the first and second components further assist in detachably coupling the first component to the second component. The operation of the garment locking system provides for ease of garment engagement for those with disabilities and individuals generally.

In accordance with embodiments of the present disclosure, an exemplary garment locking system is provided. The garment locking system includes a first component including an extension and a base element at one end of the extension. The base element defines a greater width or diameter than a width or diameter of the extension. The first component is configured to be secured to a first garment material. The garment locking system includes a second component including a body with a channel formed therein. The channel includes a cutout dimensioned to accommodate passage of the extension of the first component therethrough. The channel is dimensioned to accommodate passage of the base element therethrough. The second component is configured to be secured to a second garment material. Passage of the base element of the first component into the channel of the second component detachably couples the first component to the second component, and detachably couples the first garment material to the second garment material.

The first component can include a first magnetic or ferromagnetic material at or near the base element. The second component can include a second magnetic or ferromagnetic material complementary to the first magnetic or ferromagnetic component at or near the channel. Passage of the base element of the first component into the channel of the second component detachably couples the first magnetic or ferromagnetic material to the second magnetic or ferromagnetic material to detachably couple the first component to the second component.

The first component can include an external element connected to an end of the extension such that the external element and the base element are connected to opposing ends of the extension. A width or diameter of the external element can be dimensioned greater than the width or diameter of the base element and the extension. The second component can include a base with L-shaped extensions extending perpendicularly therefrom. The L-shaped extensions can define the channel formed in the body of the second component. The L-shaped extensions can extend from opposing sides of the base to define an opening of the channel at or near a proximal end of the second component.

The second component can include a vertical wall extending from the base at a distal end of the second component. A top surface of the vertical wall can extend substantially in-line with a top surface of the L-shaped extensions. The vertical wall at the distal end of the second component can act as a stop for passage of the base element of the first component into the channel of the second component. The second component can include an attachment opening extending therethrough for attachment of the second component to the second garment material.

In accordance with embodiments of the present disclosure, an exemplary garment locking system is provided. The garment locking system includes a first component including an extension and a base element at one end of the extension. The first component includes a first magnetic or ferromagnetic material at or near the base element. The first component is configured to be secured to a first garment material. The garment locking system includes a second component including a body with a channel with a cutout formed therein. The channel is dimensioned to accommodate passage of the base element therethrough. The second component can include a second magnetic or ferromagnetic material complementary to the first magnetic or ferromagnetic component at or near the channel. The second component is configured to be secured to a second garment material. Passage of the base element of the first component into the channel of the second component can detachably couple the first magnetic or ferromagnetic material to the second magnetic or ferromagnetic material to detachably couple the first component to the second component, and detachably couples the first garment material to the second garment material.

The base element of the first component can define a greater width or diameter than a width or diameter of the extension of the first component. The channel of the second component can include a cutout dimensioned to accommodate passage of the extension of the first component therethrough. The first magnetic or ferromagnetic material can be a magnetic or ferromagnetic layer secured to a bottom surface of the base element of the first component. The second magnetic or ferromagnetic material can be a magnetic or ferromagnetic layer secured to a top surface within the channel of the second component.

The second component can include a base with L-shaped extensions extending perpendicularly therefrom. The L-shaped extensions can define the channel formed in the body of the second component. The L-shaped extensions can extend from opposing sides of the base to define an opening of the channel at or near a proximal end of the second component. The second component can include a vertical wall extending from the base at a distal end of the second component. A top surface of the vertical wall can extend substantially in-line with a top surface of the L-shaped extensions.

In accordance with embodiments of the present disclosure, an exemplary method of detachably interlocking a garment with a garment locking system is provided. The method includes providing a first component of the garment locking system. The first component can include an extension and a base element at one end of the extension. The base element can define a greater width or diameter than a width or diameter of the extension. The first component is configured to be secured to a first garment material of the garment. The method includes providing a second component of the garment locking system. The second component can include a body with a channel formed therein. The channel can include a cutout dimensioned to accommodate passage of the extension of the first component therethrough. The channel is dimensioned to accommodate passage of the base element therethrough. The second component configured to be secured to a second garment material of the garment. The method includes passing the base element of the first component into the channel of the second component to detachably couple the first component to the second component, and to detachably couple the first garment material to the second garment material.

The first component can include a first magnetic or ferromagnetic material at or near the base element. The second component can include a second magnetic or ferromagnetic material complementary to the first magnetic or ferromagnetic component at or near the channel. The method can include passing the base element of the first component into the channel of the second component to detachably couple the first magnetic or ferromagnetic material to the second magnetic or ferromagnetic material to detachably couple the first component to the second component.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed garment locking system, reference is made to the accompanying figures, wherein.

DESCRIPTION OF EXEMPLARY EMBODIMENTS

In accordance with embodiments of the present disclosure, an exemplary garment locking system is provided that includes first and second components capable of being detachable engaged or coupled relative to each other. The first component and the second component can be secured (e.g., sewn, heat sealed/melted, glued, or the like) to opposing sides of a garment. It should be understood that one or more first and second component pairs can be used depending on the length and/or surface area of the garment to be coupled together. For example, a single pair of the first and second component can be used at the cuffs of a shirt, while ten or more pairs of the first and second components can be used at the front of the shirt. In some embodiments, the first component can be ferromagnetic and the second component can be magnetic such that engagement of the first and second components is maintained (at least partially) by a magnetic force. In some embodiments, the first component can be magnetic and the second component can be ferromagnetic. The second component can also include a slot into which a portion of the first component can slide to further secure the first component relative to the second component. The structure and functionality of the exemplary garment locking system reduces the complexity normally encountered by those with disabilities in traditional garment locking systems, allowing for ease of attachment and detachment.

Figure 1:
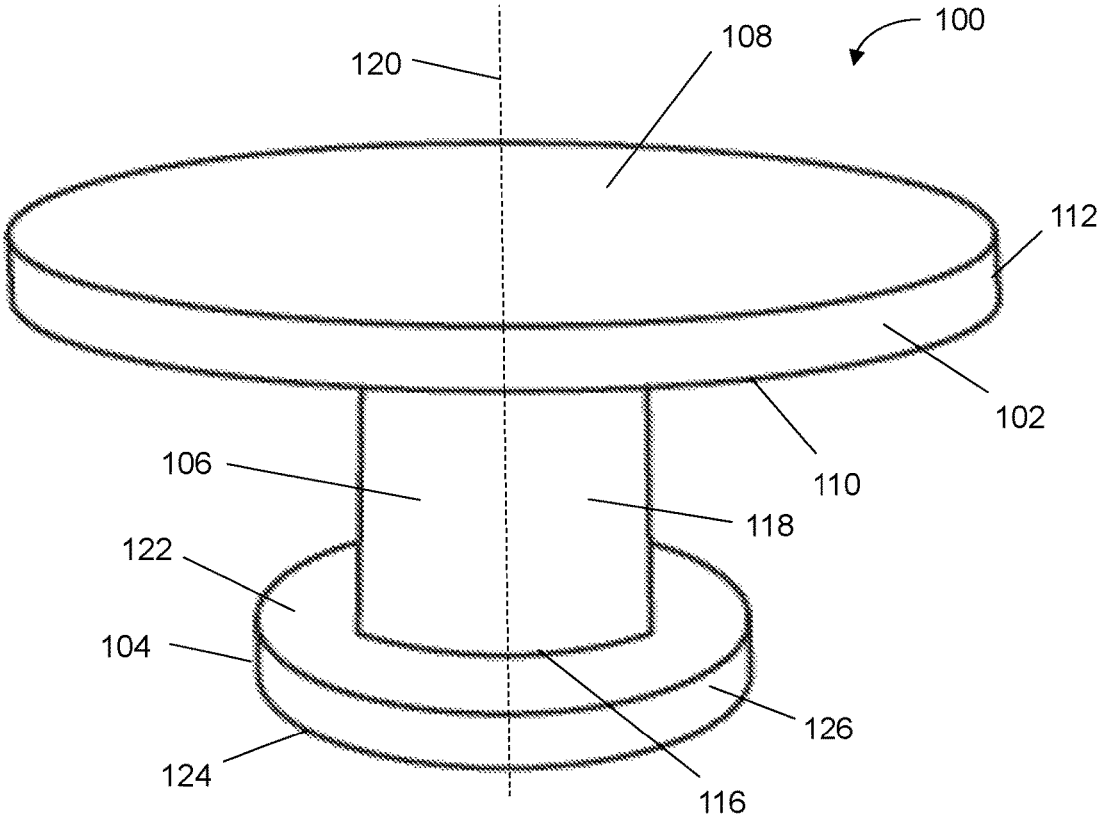
FIG. 1 is a perspective view of a first component of an exemplary garment locking system according to the present disclosure.
Figure 2:
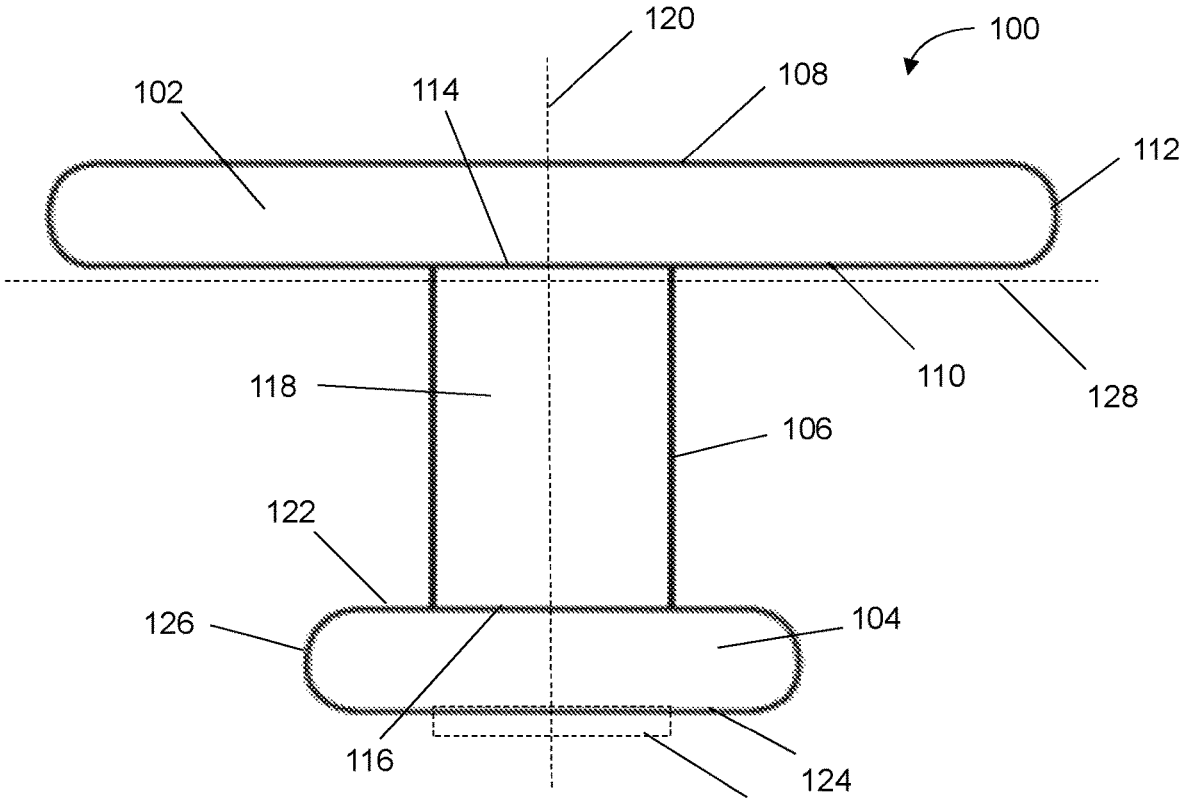
FIG. 2 is a side view of a first component of an exemplary garment locking system according to the present disclosure.
Figure 3:
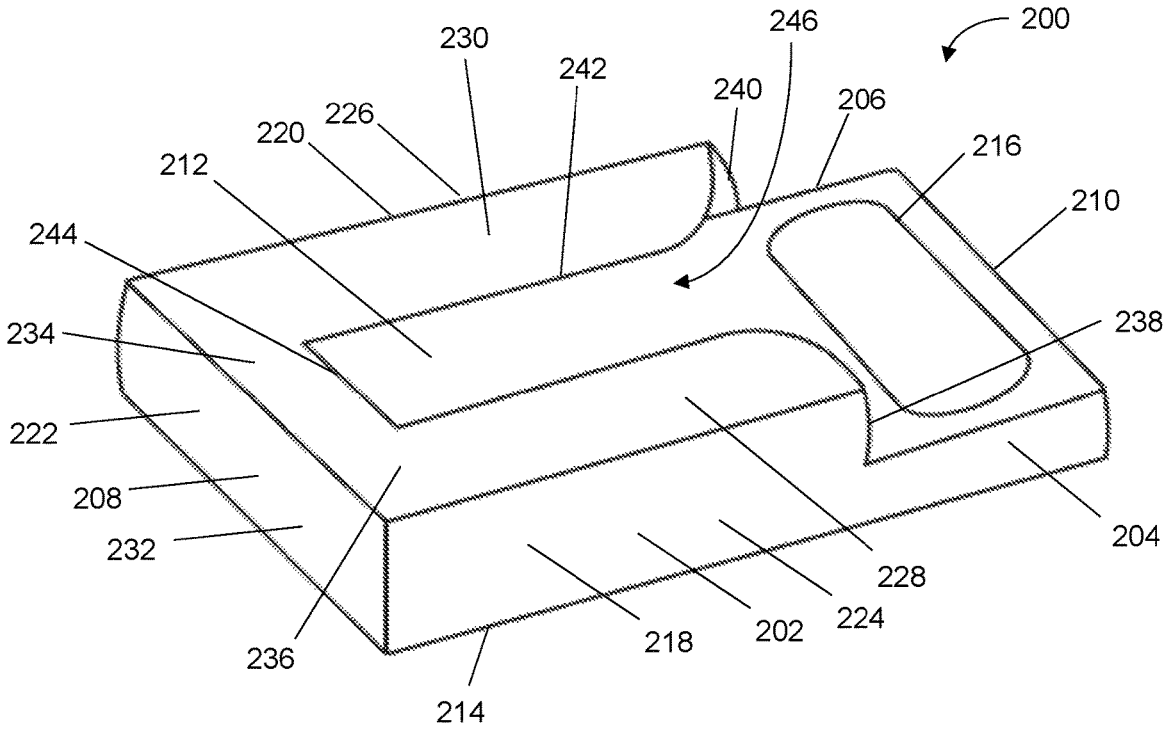
FIG. 3 is a perspective view of a second component of an exemplary garment locking system according to the present disclosure, including an elongated attachment opening.
Figure 4:
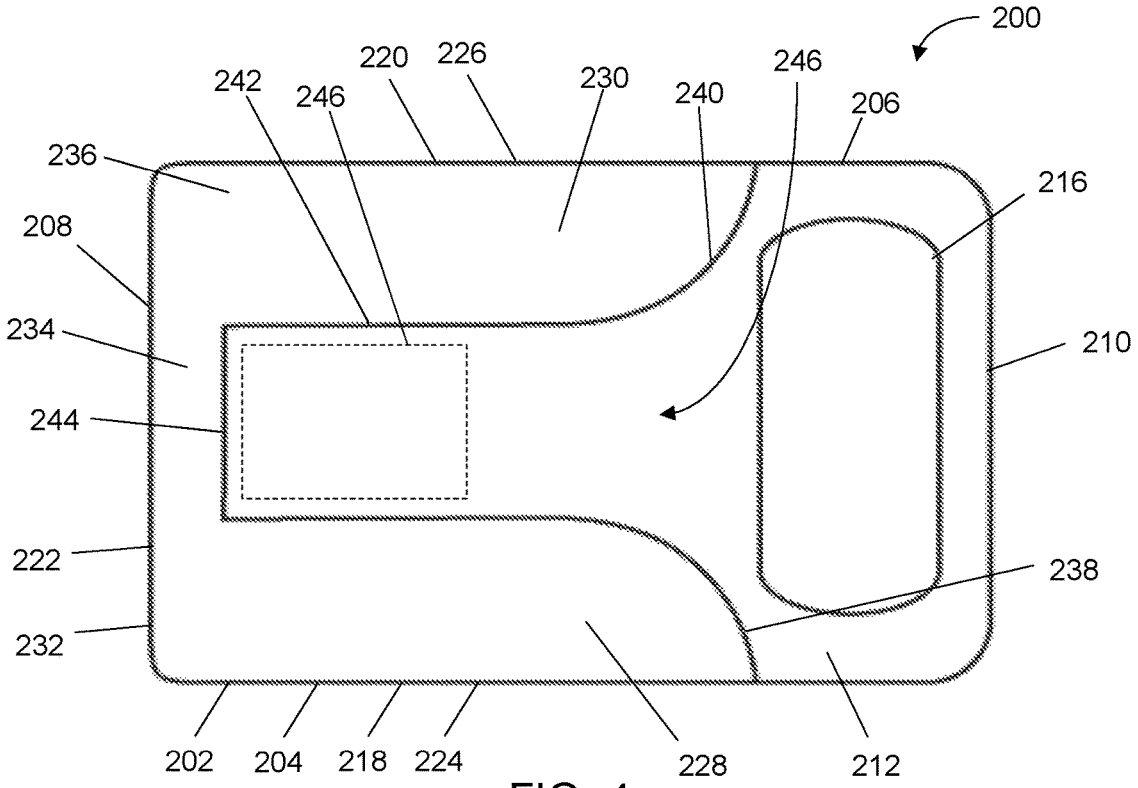
FIG. 4 is a top view of a second component of an exemplary garment locking system according to the present disclosure, including an elongated attachment opening.
Figure 5:
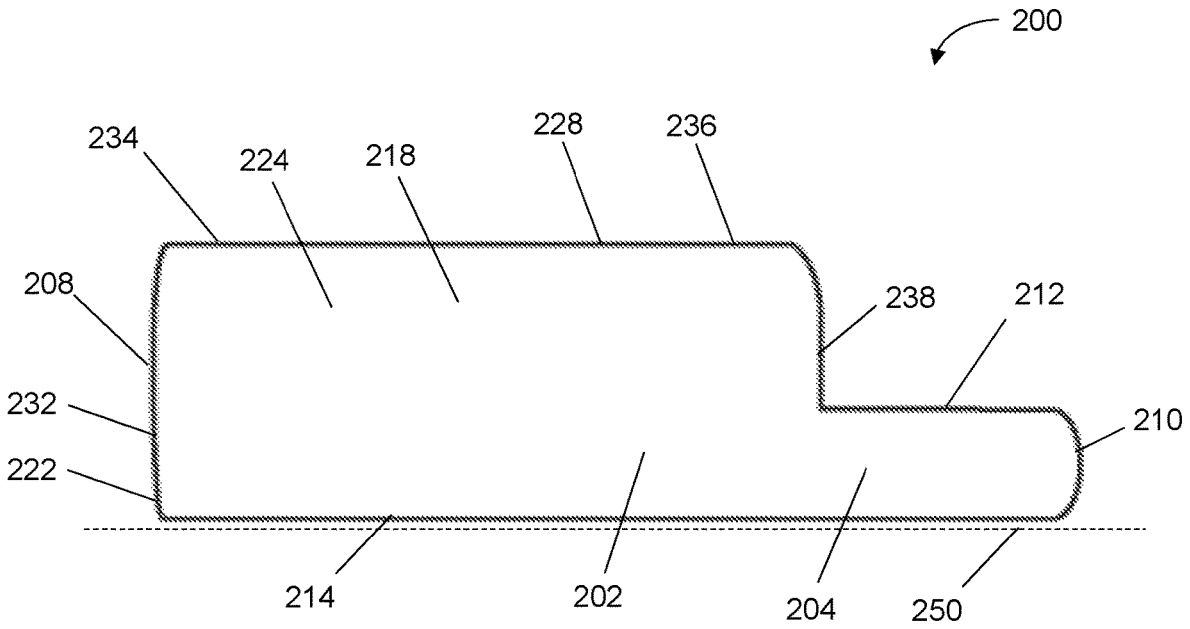
FIG. 5 is a side view of a second component of an exemplary garment locking system according to the present disclosure, including an elongated attachment opening.
Figure 6:
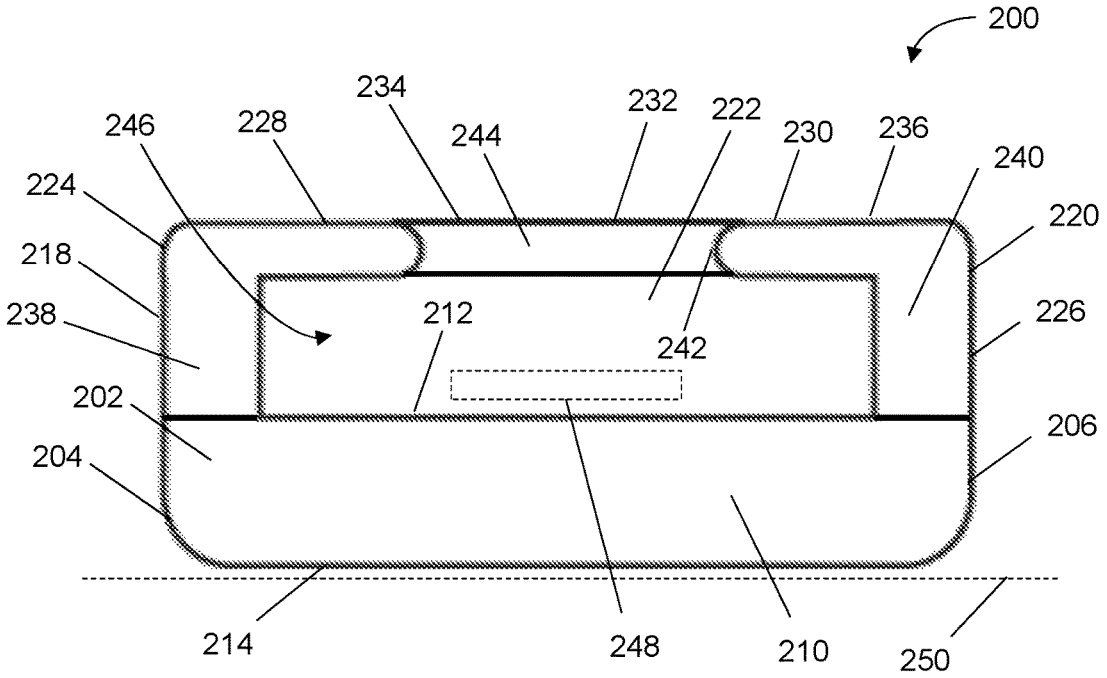
FIG. 6 is a front view of a second component of an exemplary garment locking system according to the present disclosure, including an elongated attachment opening.

FIGS. 1-2 are perspective and side views of an exemplary first component 100 of a garment locking system. The first component 100 includes an external element 102 and a base element 104 secured to opposing sides of a central extension 106. The external element 102 can define a substantially circular, cylindrical or disc-like configuration, including a top surface 108, a bottom surface 110, and a continuous round side surface 112. The top and bottom surfaces 108, 110 are on opposing sides of the external element 102. In some embodiments, the diameter or width of the external element 102 can be about, e.g., 0.25 inches to 3 inches, 0.25 inches to 2.5 inches, 0.25 inches to 2 inches, 0.25 inches to 1.5 inches, 0.25 inches to 1 inch, 0.25 inches to 0.5 inches, 0.5 inches to 3 inches, 1 inch to 3 inches, 1.5 inches to 3 inches, 2 inches to 3 inches, 2.5 inches to 3 inches, 0.25 inches to 1.25 inches, 0.5 inches to 1 inch, 0.75 inches to 1 inch, 0.25 inches, 0.5 inches, 0.75 inches, 1 inch, 1.25 inches, 1.5 inches, 2 inches, 2.5 inches, 3 inches, or the like. The height of the external element 102 as measured between the top and bottom surfaces 108, 110 can be about, e.g., 0.0625 inches to 0.125 inches, 0.0625 inches, 0.125 inches, or the like.

The top and bottom surfaces 108, 110 can define substantially flat or planar surfaces between opposing edges of the side surface 112, and can be parallel relative to each other. Although illustrated as substantially circular, cylindrical or disc-like, it should be understood that the external element 102 can be of any configuration, e.g., square, rectangular, oval, triangular, pentagonal, hexagonal, or the like. In some embodiments, the circumferential edges between the side surface 112 and the top and bottom surfaces 108, 110 can be chamfered or rounded.

The central extension 106 includes top and bottom surfaces 114, 116 on opposing sides of the central extension 106, and a continuous round side surface 118. The central extension 106 can thereby define a substantially cylindrical configuration. The external element 102 can be aligned or substantially aligned with the central extension 106 along a central longitudinal axis 120. The diameter of the central extension 106 is dimensioned smaller than the diameter of the external element 102. In some embodiments, the diameter of the central extension 106 can be about, e.g., 0.125 inches to about 2 inches, 0.125 inches to 1.5 inches, 0.125 inches to 1 inch, 0.125 inches to 0.75 inches, 0.125 inches to 0.5 inches, 0.125 inches to 0.25 inches, 0.25 inches to 2 inches, 0.5 inches to 2 inches, 0.75 inches to 2 inches, 1 inch to 2 inches, 1.5 inches to 2 inches, 0.125 inches, 0.25 inches, 0.5 inches, 0.75 inches, 1 inch, 1.5 inches, 2 inches, or the like. The height of the central extension 106 (as measured between the top and bottom surfaces 114, 116) is dimensioned longer than the height of the external element 102. In some embodiments, the height of the central extension 106 can be about, e.g., 0.125 inches to about 1 inch, 0.1875 inches to 1 inch, 0.25 inches to 1 inch, 0.375 inches to 1 inch, 0.5 inches to 1 inch, 0.625 inches to 1 inch, 0.75 inches to 1 inch, 0.875 inches to 1 inch, 0.125 inches to 0.875 inches, 0.125 inches to 0.75 inches, 0.125 inches to 0.625 inches, 0.125 inches to 0.5 inches, 0.125 inches to 0.375 inches, 0.125 inches to 0.25 inches, 0.125 inches, 0.25 inches, 0.375 inches, 0.5 inches, 0.625 inches, 0.75 inches, 0.875 inches, 1 inch, or the like. In some embodiments, the height of the central extension 106 can be updated based on the thickness of the material of the fabric. For example, for thinner fabrics, the height can be closer to 0.125 inches and for thicker fabrics the height can be closer to 0.75 inches.

The top and bottom surfaces 114, 116 can define substantially flat and parallel surfaces. In some embodiments, the central extension 106 and the external element 102 can be fabricated as separate, individual components, and the top surface 114 of the central extension 106 can be fixated or coupled to the bottom surface 110 of the external element 102. In some embodiments, the central extension 106 and the external element 102 can be fabricated as a single part or component. In some embodiments, the central extension 106 can define a cylindrical configuration. In some embodiments, the central extension 106 can define, e.g., a square, circular, rectangular, triangular, oval, or the like, cross-sectional shape.

The base element 104 includes top and bottom surfaces 122, 124 on opposing sides of each other, and a continuous round side surface 126. The base element 104 can be aligned or substantially aligned with the central extension 106 and the external element 102 along the central longitudinal axis 120. The diameter of the base element 104 can be dimensioned smaller than the diameter of the external element 102 and greater than the diameter of the central extension 106. In some embodiments, the diameter of the base element 104 can be about, e.g., 0.25 inches to 0.75 inches, 0.375 inches to 0.75 inches, 0.4375 to 0.75 inches, 0.5 inches to 0.75 inches, 0.625 inches to 0.75 inches, 0.125 inches to 0.625 inches, 0.125 inches to 0.5 inches, 0.125 inches to 0.4375 inches, 0.125 inches to 0.375 inches, 0.125 inches to 0.25 inches, 0.25 inches to 0.5 inches, 0.125 inches, 0.25 inches, 0.375 inches, 0.4375 inches, 0.5 inches, 0.625 inches, 0.75 inches, or the like. The height of the base element 106 (as measured between the top and bottom surfaces 122, 124) can be dimensioned smaller than the height of the central extension 106. In some embodiments, the height of the base element 106 can be dimensioned substantially equal to the height of the external element 102. In some embodiments, the height of the base element 106 can be about, e.g., 0.09375 inches to 0.75 inches, 0.125 inches to 0.75 inches, 0.25 inches to 0.75 inches, 0.375 inches to 0.75 inches, 0.5 inches to 0.75 inches, 0.625 inches to 0.75 inches, 0.09375 inches to 0.625 inches, 0.09375 inches to 0.5 inches, 0.09375 inches to 0.375 inches, 0.09375 inches to 0.25 inches, 0.09375 inches to 0.125 inches, 0.09375 inches, 0.125 inches, 0.25 inches, 0.375 inches, 0.5 inches, 0.625 inches, 0.75 inches, or the like.

The top and bottom surfaces 122, 124 can define substantially flat and parallel surfaces. In some embodiments, the circumferential edges between the side surface 126 and the top and bottom surfaces 122, 124 can be chamfered or rounded. In some embodiments, base element 104 can be fabricated as a separate, individual component from the central extension 106, and the top surface 122 of the base element 104 can be fixated or coupled to the bottom surface 116 of the central extension 106. In some embodiments, the central extension 106 and the base element 104 can be fabricated as a single part or component. The base element 104 generally defines a cylindrical configuration.

In use, the first component 100 can be secured to a layer of garment material 128 such that the external element 102 is positioned on one side of the garment material 128 (e.g., the outward or visible side of the garment). The first component 100 can be secured to the garment material 128 by, e.g., sewing, heat sealing, adhesive, combinations thereof, or the like. The top surface 114 of the central extension 106 and a portion of the central extension 106 near the top surface 114 is positioned on the same side of the garment material 128 as the external element 102, extends through the garment material 128, and extends further on the opposing side of the garment material 128. The base element 104 is positioned entirely on the opposing side of the garment material 128 (e.g., the inward or hidden side of the garment) as compared to the external element 102. In some embodiments, the first component 100 can be secured to a layer of garment material 128 by passing the base element 104 and partially passing the central extension 106 through a hole in the garment material 128 (e.g., a button hole) such that the central extension 106 is encircled by the garment material 128, and the hole can be sewn to reduce the width and/or diameter of the hole to ensure the first component 100 is not inadvertently removed from the garment material 128.

The central extension 106 can be fabricated from, e.g., plastic, metal, a ferromagnetic material, or the like. In some embodiments, the external element 102 can be fabricated from natural materials, e.g., wood, shell, bone, or the like. In some embodiments, the external element 102 can be fabricated from manmade or synthetic materials, e.g., plastic, metal, any material used for traditional buttons, the like. As will be discussed in greater detail below, the base element 104 can be magnetic or ferromagnetic to detachably engage with a magnetic or ferromagnetic portion of the second component. In some embodiments, the base element 104 can be fabricated entirely from the magnetic or ferromagnetic material. In some embodiments, only the bottom surface 124 of the base element 104 can be magnetic or ferromagnetic. In some embodiments, the bottom surface 124 and/or at least a portion of the side surface 126 extending from the bottom surface 124 can be magnetic or ferromagnetic. In some embodiments, a magnetic or ferromagnetic element (e.g., layer 130 of FIG. 2) can be secured to the bottom surface 124 of the base element 104. In some embodiments, adhesive (e.g., super glue, industrial glue, or the like) can be used to secure the layer 130 to the bottom surface 124 of the base element 104.

FIGS. 3-6 are perspective, top, side and front views of an exemplary second component 200 of a garment locking system. The second component 200 includes a base 202 that defines a substantially rectangular configuration with sides 204-210, a top surface 212, and a bottom surface 214. The second component 200 can be fabricated from, e.g., a flexible plastic, or the like. In some embodiments, the second component 200 can be injection molded and/or 3D printed. However, it should be understood that the base 202 of the second component 200 can define a different configuration, e.g., circular, oval, square, or the like. In the embodiment of FIGS. 3-6, the sides 204, 206 can be substantially parallel to each other, the sides 208, 210 can be substantially parallel to each other, and the top and bottom surfaces 212, 214 can be substantially parallel to each other. Each of the sides 204-210, the top surface 212, and the bottom surface 214 can be substantially planar or flat. Side 210 can define the proximal end of the second component 200, and side 208 can define the distal end of the second component 200.

Figure 7:
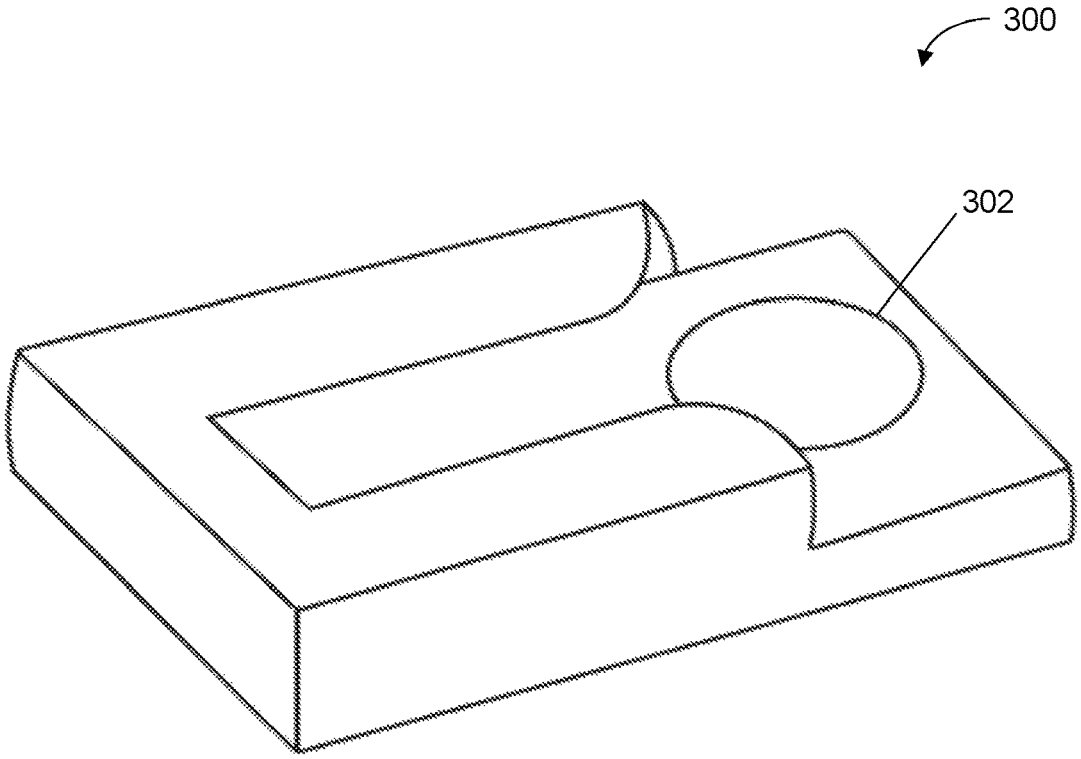
FIG. 7 is a perspective view of a second component of an exemplary garment locking system according to the present disclosure, including a circular attachment opening.
Figure 8:
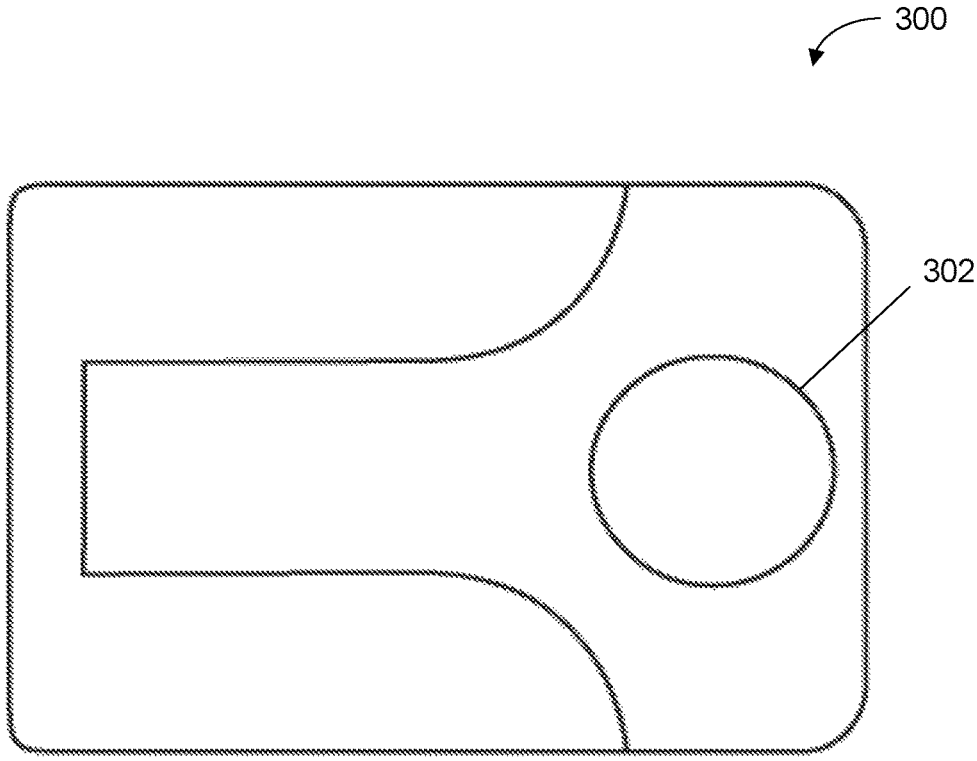
FIG. 8 is a top view of a second component of an exemplary garment locking system according to the present disclosure, including a circular attachment opening.
Figure 9:
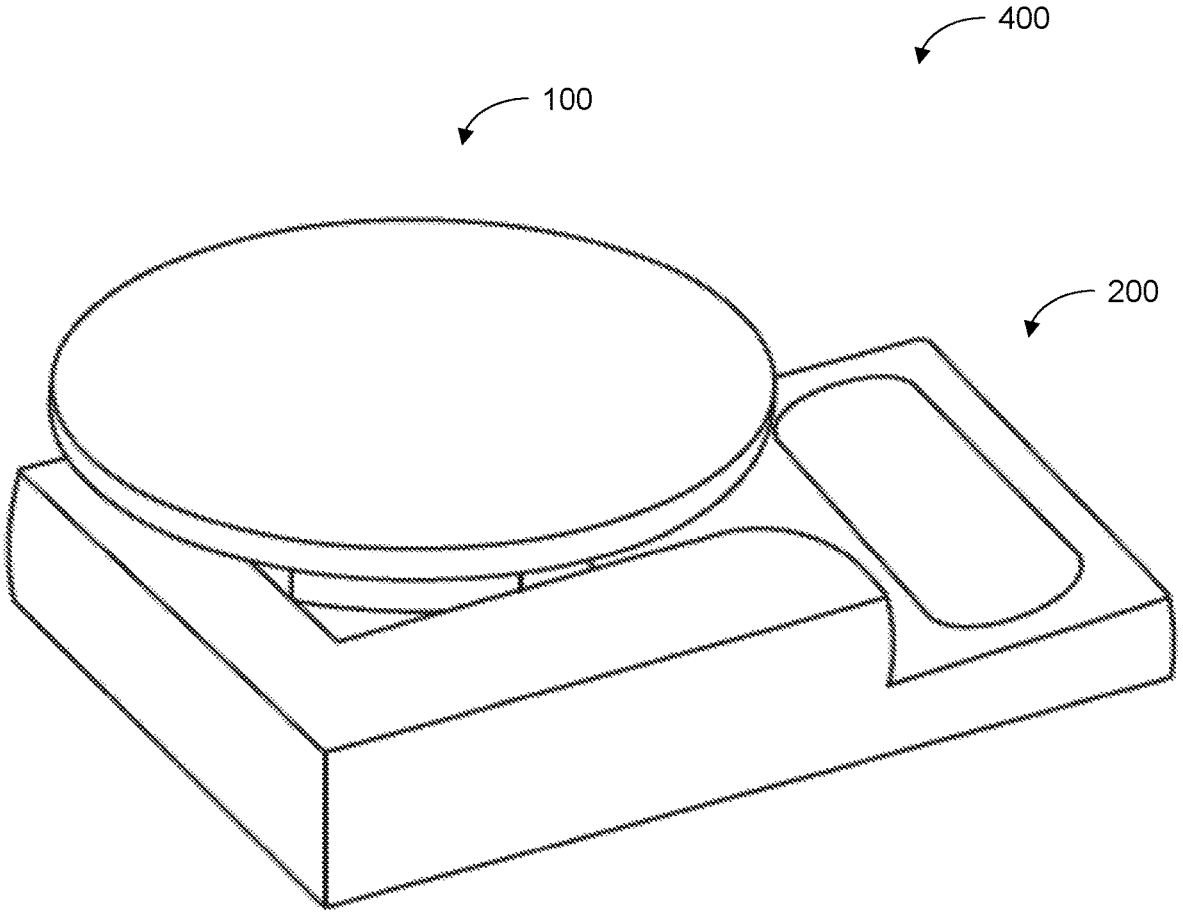
FIG. 9 is a perspective view of an exemplary garment locking system according to the present disclosure, including a first component detachably engaged with a second component.
Figure 10:
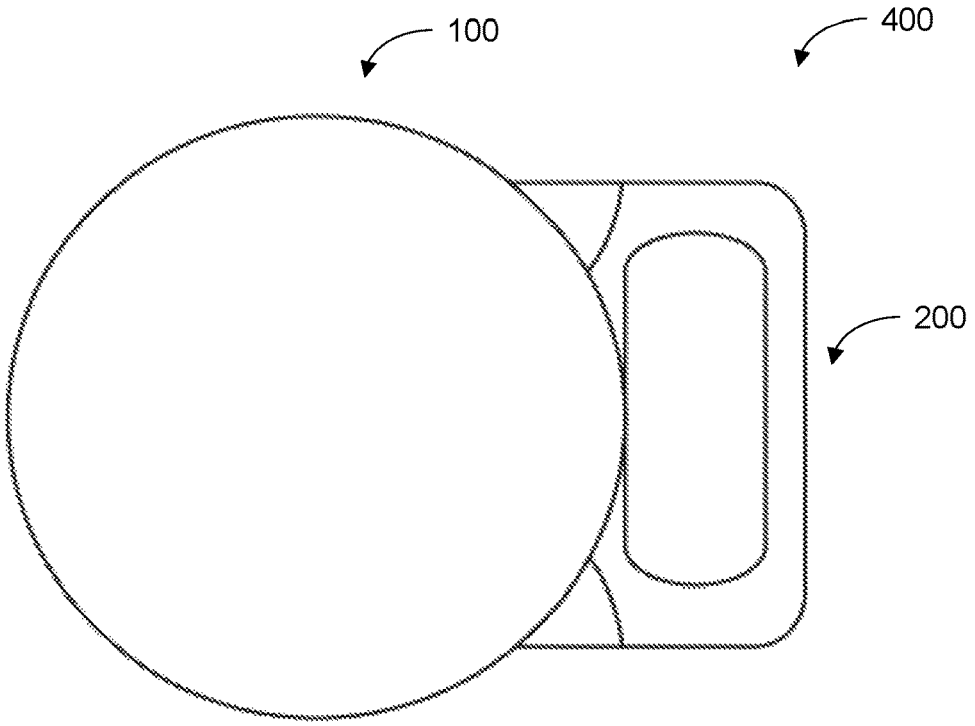
FIG. 10 is a top view of an exemplary garment locking system according to the present disclosure, including a first component detachably engaged with a second component having an elongated attachment opening.

In some embodiments, the length of the sides 204, 206 can be about, e.g., 0.21875 inches to 1.3125 inches, 0.25 inches to 1.3125 inches, 0.5 inches to 1.3125 inches, 0.75 inches to 1.3125 inches, 1 inch to 1.3125 inches, 1.0625 inches to 1.3125 inches, 1.25 inches to 1.3125 inches, 0.21875 inches to 1.25 inches, 0.21875 inches to 1.0625 inches, 0.21875 inches to 1 inch, 0.21875 inches to 0.75 inches, 0.21875 inches to 0.5 inches, 0.21875 inches to 0.25 inches, 0.21875 inches, 0.25 inches, 0.5 inches, 0.75 inches, 1 inch, 1.0625 inches, 1.25 inches, 1.3125 inches, or the like. In some embodiments, the length of the sides 208, 210 can be about, e.g., 0.25 inches to 0.75 inches, 0.5 inches to 0.75 inches, 0.625 inches to 0.75 inches, 0.6875 inches, 0.25 inches to 0.6875 inches, 0.25 inches to 0.625 inches, 0.25 inches to 0.5 inches, 0.25 inches, 0.5 inches, 0.625 inches, 0.6875 inches, 0.75 inches, or the like. In some embodiments, the thickness or height of the base 202 as measured between the top and bottom surfaces 212, 214 can be about, e.g., 0.125 inches to 0.375 inches, 0.25 inches to 0.375 inches, 0.125 inches to 0.25 inches, 0.125 inches, 0.25 inches, 0.375 inches, or the like. At or near the proximal end (e.g., side 210), the second component 200 includes an attachment opening 216. The attachment opening 216 can define a substantially rectangular opening with curves opposing edges. However, in some embodiments, the attachment opening 216 can be, e.g., circular, rectangular, square, oval, or the like. As an example, FIGS. 7-8 are perspective and top views of an exemplary second component 200 having the same structure and function as the second component 200, except that the attachment opening 302 defines a circular configuration.

Figure 14:
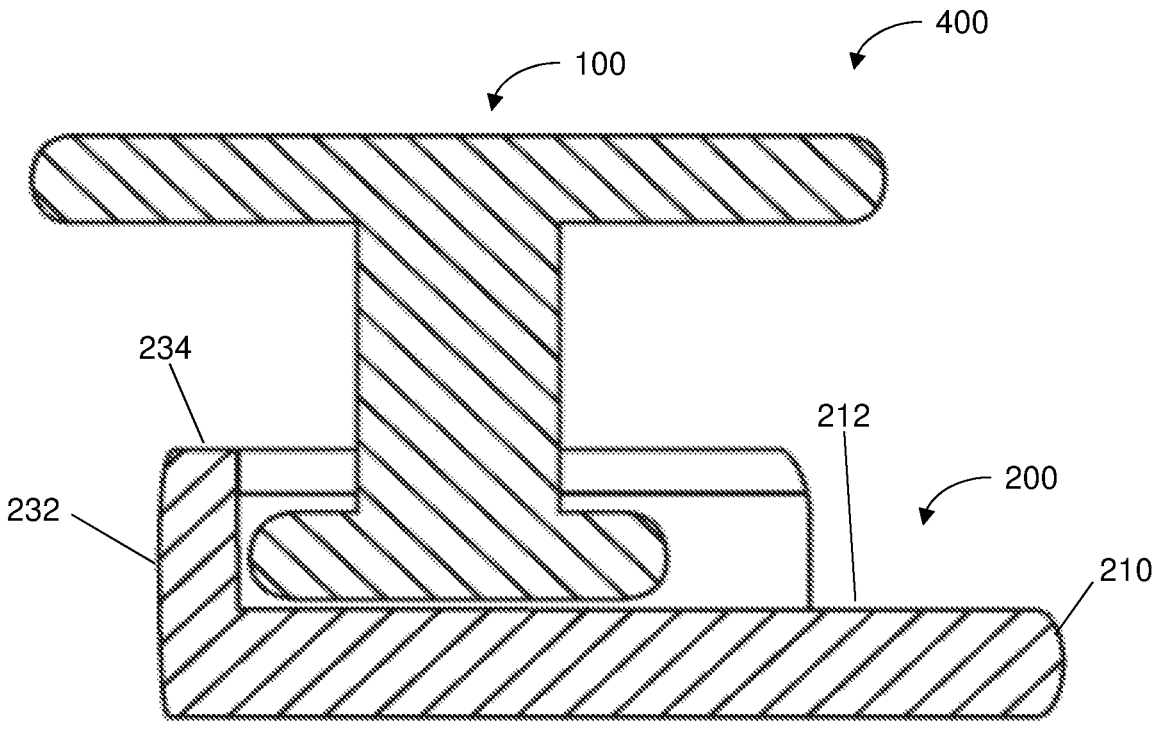
FIG. 14 is a cross-sectional side view of an exemplary garment locking system according to the present disclosure, including a first component detachably engaged with a second component.
Figure 15:
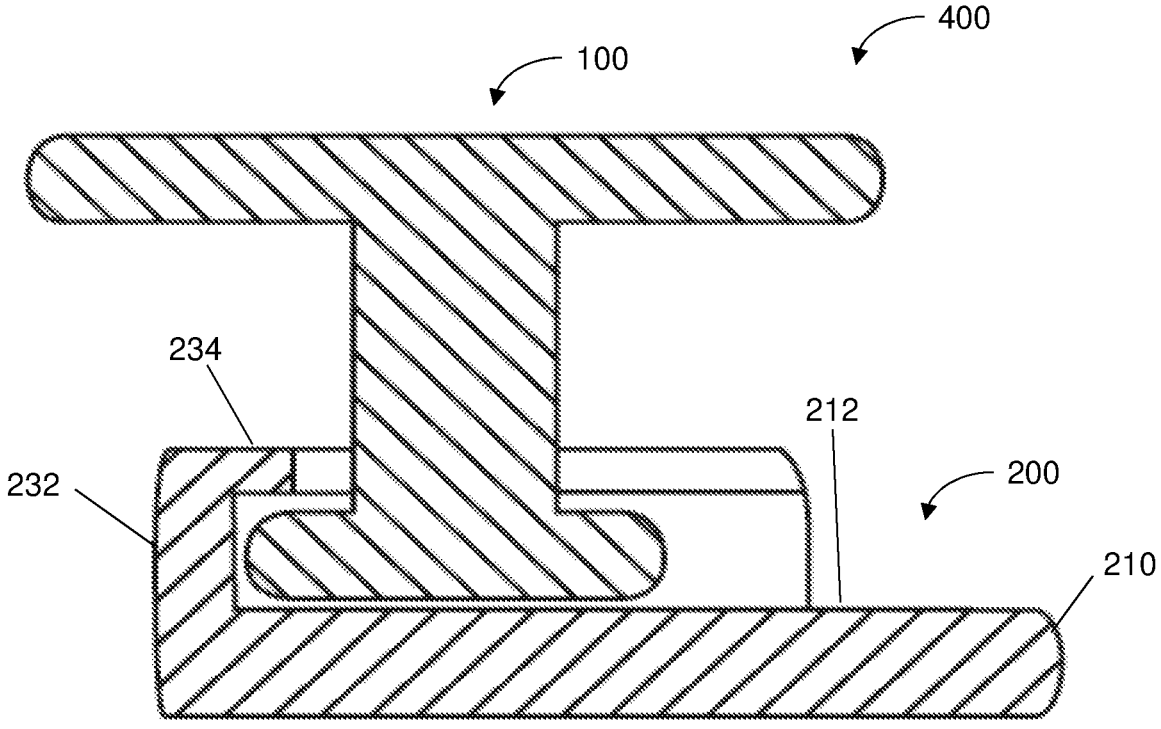
FIG. 15 is a cross-sectional side view of an exemplary garment locking system according to the present disclosure, including a first component detachably engaged with a second component.

Still with reference to FIGS. 3-6, at a point between the proximal and distal ends (e.g., between sides 208, 210), the second component 200 includes L-shaped extensions 218, 220 extending substantially perpendicularly from the top surface 212 at the sides 204, 206. The second component 200 further includes an L-shaped extension 222 extending substantially perpendicularly from the top surface 212 at the side 208. In some embodiments, the extensions 218-222 and the base 202 can be formed as a single molded part such that the extensions 218-222 and base 202 form the body of the second component 200. Each of the extensions 218, 220 includes a vertical wall 224, 226 extending perpendicularly from the top surface 212 and having an outer wall in-line with the outer wall of the sides 204, 206, respectively. Each of the extensions 218, 220 includes a horizontal wall 228, 230 extending perpendicularly from the respective vertical wall 224, 226 over the top surface 212 and towards each other in a facing relationship. The extension 222 similarly includes a vertical wall 232 extending perpendicularly from the top surface 212 and having an outer wall in-line with the outer wall of the side 208, and a horizontal wall 234. In some embodiments, the horizontal wall 234 can extend perpendicularly from the vertical wall 232 over the top surface 212 and towards the side 210. In some embodiments, the horizontal wall 234 can be the wall thickness of the vertical wall 232 without extending over the top surface 212. For example, FIG. 14 shows a cross-sectional view of the vertical wall 232 and the horizontal wall 234 having the wall thickness of the vertical wall 232, while FIG. 15 shows a cross-sectional view of the horizontal wall 234 extending perpendicularly from the vertical wall 232 over the top surface 212 and towards the side 210 (e.g., an L-shaped cross-sectional structure).

Each of the horizontal walls 228, 230, 234 connect around the perimeter of the second component 200 to define a uniform, U-shaped top surface 236. The height of the extensions 218-222 as measured between the top surfaces 212, 236 can be about, e.g., 0.125 inches to 0.5 inches, 0.15625 inches to 0.5 inches, 0.25 inches to 0.5 inches, 0.375 inches to 0.5 inches, 0.125 inches to 0.375 inches, 0.125 inches to 0.25 inches 0.125 inches to 0.15625 inches, 0.125 inches, 0.15625 inches, 0.25 inches, 0.375 inches, 0.5 inches, or the like. The raised extensions 218-222 from the top surface 212 form steps 238, 240 at the proximal ends of the extensions 218, 220. The steps 238, 240 can be substantially linear or perpendicular relative to the top surface 236, or can be tapered or curved to gradually connect with the top surface 236. In some embodiments, the steps 238, 240 can be at a midpoint between the sides 208, 210. In some embodiments, the steps 238, 240 can be spaced from the side 210 by about, e.g., 0.25 inches to 0.5 inches, 0.375 inches to 0.5 inches, 0.25 inches to 0.375 inches, 0.25 inches, 0.375 inches, 0.5 inches, or the like.

The second component 200 includes a cutout 242 in the top surface 236 that extends at or from the steps 238, 240 towards an inner edge 244 of the horizontal wall 234. The inner edge 244 can act as a stop during engagement with the first component 100. The cutout 242 can define a substantially rectangular configuration. The cutout 242 extends downwardly from the top surface 236 and into a channel 246 formed between the extensions 218-222. The channel 246 includes an opening at the proximal end of the extensions 218-222 and extends inwardly up to the vertical wall 232 of the extension 222. The width of the cutout 242 (as defined by the distance between the inner edges of the horizontal walls 228, 230) can be dimensioned slightly greater than the diameter of the central extension 106 of the first component 100. The width of the channel 246 (as defined by the distance between the inner surfaces of the vertical walls 224, 226) can be dimensioned slightly greater than the diameter of the base element 104. In some embodiments, the width of the channel 246 can be about, e.g., 0.3125 inches to 0.5625 inches, 0.375 inches to 0.5625 inches, 0.5 inches to 0.5625 inches, 0.3125 inches to 0.5 inches, 0.3125 inches to 0.375 inches, 0.325 inches, 0.375 inches, 0.5 inches, 0.5625 inches, or the like.

At least a portion of the top surface 212 in the channel 246 and/or at least a portion of the extensions 218-222 can be fabricated from or can include a magnetic or ferromagnetic material or layer (for example, layer 248 of FIGS. 4 and 6) complementary to the magnetic or ferromagnetic material or layer 130 of the first component 100. For example, the layer 248 can be disposed on the top surface 212 at or near the distal end of the channel 246. In some embodiments, the layer 248 can be secured to the top surface 212 and/or the inner layer of the side 208 with adhesive. The first component 100 can therefore include the magnetic layer 130 and the second component 200 can include the ferromagnetic layer 246 (or vice versa) such that the first component 100 can be detachably coupled to the second component 200.

The second component 200 can be secured to a layer of garment material 250 at the bottom surface 214 such that the second component 200 is entirely positioned on one side of the garment material 250. The second component 200 can be secured to the garment material 250 by, e.g., sewing, heat sealing, adhesive, combinations thereof, or the like. In some embodiments, the second component 200 can be partially melted to secure the second component 200 to the garment material 250. As an example, the external element 102 of the first component 100 can be positioned at the outwardly facing side of the garment material 128, and the magnetic or ferromagnetic base element 104 of the first component 100 can be positioned at the inwardly facing side of the garment material 128. The second component 200 can be positioned at the outwardly facing side of the garment material 250 that is to be detachably secured to the inwardly facing side of the garment material 128, with the magnetic or ferromagnetic layer 248 facing the magnetic or ferromagnetic layer 130 of the first component 100.

Figure 11:
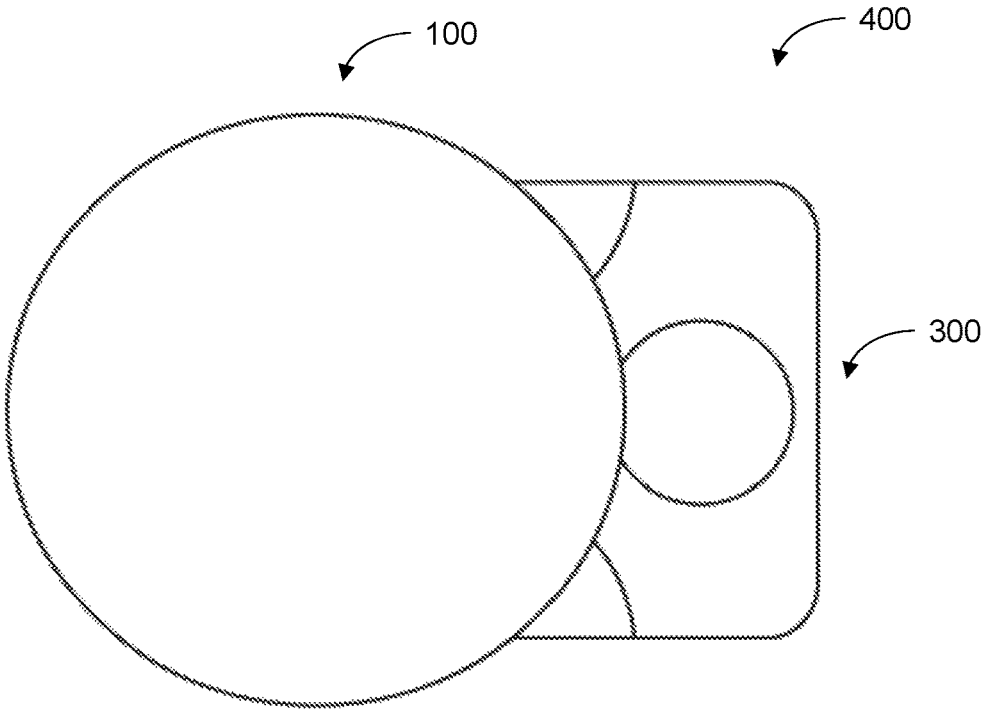
FIG. 11 is a top view of an exemplary garment locking system according to the present disclosure, including a first component detachably engaged with a second component having a circular attachment opening.
Figure 12:
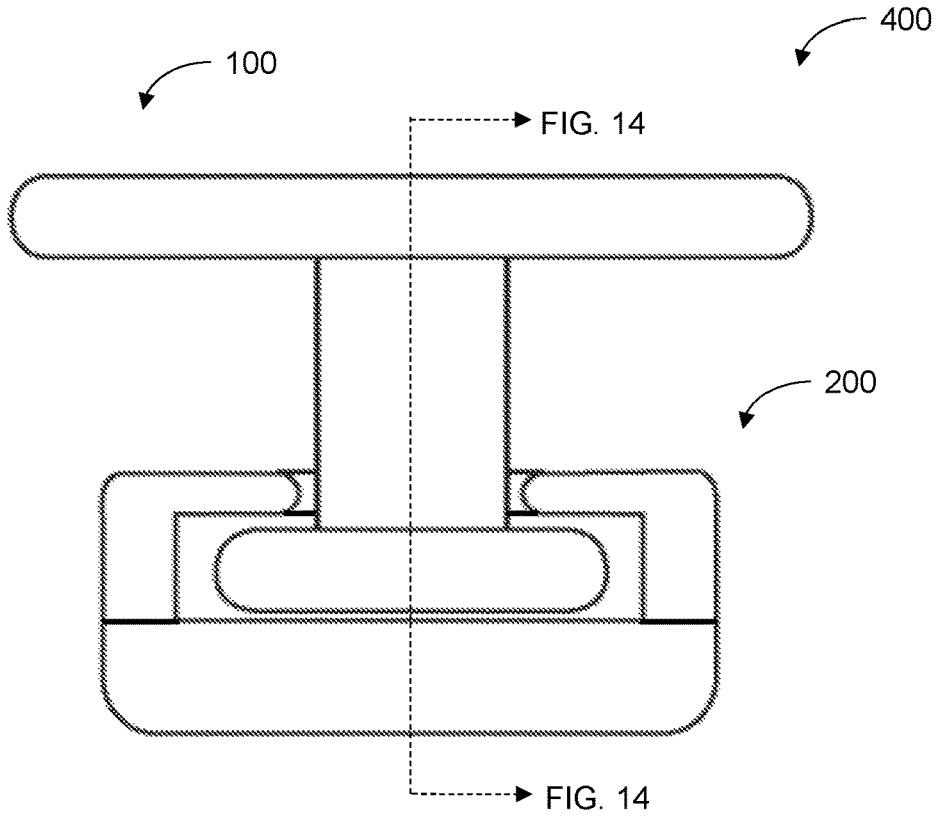
FIG. 12 is a front view of an exemplary garment locking system according to the present disclosure, including a first component detachably engaged with a second component.
Figure 13:
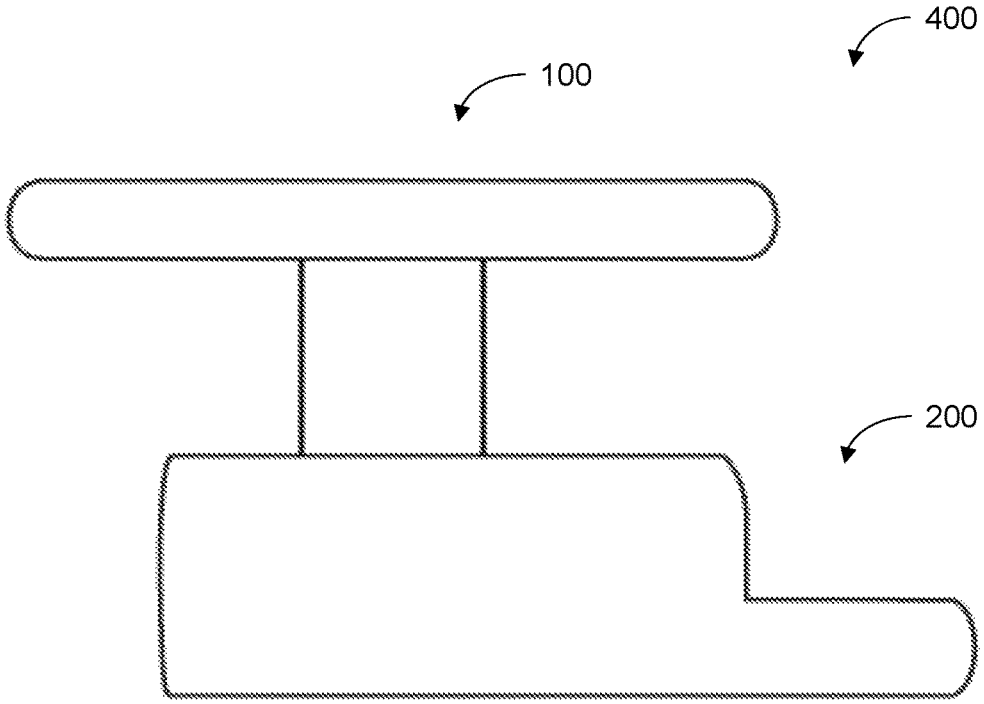
FIG. 13 is a side view of an exemplary garment locking system according to the present disclosure, including a first component detachably engaged with a second component.

FIGS. 9, 10, 12-14 show perspective, top, front, side and cross-sectional views of the first component 100 engaged with the second component 200, and FIG. 11 shows the first component 100 engaged with the second component 300. The combination of the first component 100 with the second component 200 (or the second component 300) can be referred to as a garment locking system 400. In operation, to detachably engage the first component 100 with the second component 200, the base element 104 can be aligned with the opening at the proximal end of the channel 146 of the second component 200, and the base element 104 can be slid into the channel 146 in the direction of the distal end of the second component 200. The width of the cutout 242 allows for the central extension 106 to pass through the cutout 242, while the wider dimensions of the base element 104 as compared to the narrower dimensions of the cutout 242 prevent the base element 104 from being lifted out of and detached from the second component 200. Slight tension in the attached garment materials 128, 250 can assist in maintaining the position of the base element 104 within the channel 246.

The complementary magnetic or ferromagnetic materials or layers 130, 248 can further urge the base element 104 deeper into the channel 246 towards the distal end and maintain the position of the base element 104 at the distal end of the channel 246 until disengagement of the first and second components 100, 200 is desired. To disengage the first component 100 from the second component 200, slight pressure can be applied to overcome the magnetic/ferromagnetic attraction of the layers 128, 248 (and/or any tension from the garment materials 128, 250) to urge the base element 104 towards the opening at the proximal end of the channel 246. The base element 104 can subsequently be removed from the channel 246. The number of garment locking systems 400 used can depend on the length and/or size of the garment areas to be engaged with each other. The configuration of the first and second components 100, 200, 300, the magnetic/ferromagnetic attraction, and/or combinations thereof, simplify the procedure needed to secure two sections of garment to each other, allowing for ease of use for those with disabilities and for individuals generally.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A garment locking system, comprising:

a first component including an extension and a base element at one end of the extension, the base element defining a greater width or diameter than a width or diameter of the extension, the first component configured to be secured to a first garment material such that the extension at least partially extends through the first garment material, with at least a portion of the extension and the base element disposed on opposing sides of the first garment material; and a second component including a body with a channel formed therein, the channel including a cutout dimensioned to accommodate passage of the extension of the first component therethrough, and the channel dimensioned to accommodate passage of the base element therethrough, the second component configured to be secured to a second garment material such that the second component is entirely disposed on one side of the second garment material;

wherein the passage of the base element of the first component into the channel of the second component detachably couples the first component to the second component, and detachably couples the first garment material to the second garment material.

2. The garment locking system of claim 1, wherein the first component includes a first magnetic or ferromagnetic material at or near the base element.

3. The garment locking system of claim 2, wherein the second component includes a second magnetic or ferromagnetic material complementary to the first magnetic or ferromagnetic material at or near the channel.

4. The garment locking system of claim 3, wherein the passage of the base element of the first component into the channel of the second component detachably couples the first magnetic or ferromagnetic material to the second magnetic or ferromagnetic material to detachably couple the first component to the second component.

5. The garment locking system of claim 1, wherein the first component includes an external element connected to an end of the extension such that the external element and the base element are connected to opposing ends of the extension.

6. The garment locking system of claim 5, wherein a width or diameter of the external element is dimensioned greater than the width or diameter of the base element and the extension.

7. The garment locking system of claim 1, wherein the second component includes a base with L-shaped extensions extending perpendicularly therefrom, the L-shaped extensions defining the channel formed in the body of the second component.

8. The garment locking system of claim 7, wherein the L-shaped extensions extend from opposing sides of the base to define an opening of the channel at or near a proximal end of the second component.

9. The garment locking system of claim 8, wherein the second component includes a vertical wall extending from the base at a distal end of the second component, a top surface of the vertical wall extending in-line with a top surface of the L-shaped extensions.

10. The garment locking system of claim 9, wherein the vertical wall at the distal end of the second component acts as a stop for the passage of the base element of the first component into the channel of the second component.

11. The garment locking system of claim 1, wherein the second component includes an attachment opening extending therethrough for attachment of the second component to the one side of the second garment material.

12. A garment locking system, comprising:

a first component including an extension and a base element at one end of the extension, the first component including a first magnetic or ferromagnetic material at or near the base element, the first component configured to be secured to a first garment material such that the extension at least partially extends through the first garment material, with at least a portion of the extension and the base element disposed on opposing sides of the first garment material; and a second component including a body with a channel with a cutout formed therein, the channel dimensioned to accommodate passage of the base element therethrough, the second component including a second magnetic or ferromagnetic material complementary to the first magnetic or ferromagnetic material at or near the channel, the second component configured to be secured to a second garment material such that the second component is entirely disposed on one side of the second garment material;

wherein the passage of the base element of the first component into the channel of the second component detachably couples the first magnetic or ferromagnetic material to the second magnetic or ferromagnetic material to detachably couple the first component to the second component, and detachably couples the first garment material to the second garment material.

13. The garment locking system of claim 12, wherein the base element of the first component defines a greater width or diameter than a width or diameter of the extension of the first component.

14. The garment locking system of claim 13, wherein the cutout is dimensioned to accommodate passage of the extension of the first component therethrough.

15. The garment locking system of claim 12, wherein the first magnetic or ferromagnetic material is a magnetic or ferromagnetic layer secured to a bottom surface of the base element of the first component, and the second magnetic or ferromagnetic material is a magnetic or ferromagnetic layer secured to a top surface within the channel of the second component.

16. The garment locking system of claim 12, wherein:

the second component includes a base with L-shaped extensions extending perpendicularly therefrom, the L-shaped extensions defining the channel formed in the body of the second component;

the L-shaped extensions extend from opposing sides of the base to define an opening of the channel at or near a proximal end of the second component; and the second component includes a vertical wall extending from the base at a distal end of the second component, a top surface of the vertical wall extending in-line with a top surface of the L-shaped extensions.

17. A method of detachably interlocking a garment, comprising:

securing a first component of a garment locking system to a first garment material of the garment, the first component including an extension and a base element at one end of the extension, the base element defining a greater width or diameter than a width or diameter of the extension, the first component secured to the first garment material of the garment such that the extension at least partially extends through the first garment material, with at least a portion of the extension and the base element disposed on opposing sides of the first garment material;

securing a second component of the garment locking system to a second garment material of a garment, the second component including a body with a channel formed therein, the channel including a cutout dimensioned to accommodate passage of the extension of the first component therethrough, and the channel dimensioned to accommodate passage of the base element therethrough, the second component secured to the second garment material of the garment such that the second component is entirely disposed on one side of the second garment material;

passing the base element of the first component into the channel of the second component to detachably couple the first component to the second component, and to detachably couple the first garment material to the second garment material.

18. The method of claim 17, wherein the first component includes a first magnetic or ferromagnetic material at or near the base element.

19. The method of claim 18, wherein the second component includes a second magnetic or ferromagnetic material complementary to the first magnetic or ferromagnetic material at or near the channel.

20. The method of claim 19, comprising passing the base element of the first component into the channel of the second component to detachably couple the first magnetic or ferromagnetic material to the second magnetic or ferromagnetic material to detachably couple the first component to the second component.

* * * * *